US009603763B2

(12) United States Patent
Smith et al.

(10) Patent No.: US 9,603,763 B2
(45) Date of Patent: Mar. 28, 2017

(54) DISPOSABLE SHOWER BUCKET AND THE PRIVACY JACKET

(76) Inventors: Shirley Smith, Fort Smith, AR (US); Jacklyn Smith Sanders, Cypress, TX (US); Dedtra Deneat Smith, Fort Smith, AR (US); Christina Smith-Massey, Fort Smith, AR (US); Justice Lugretta Smith, Fort Smith, AR (US); Micheal Smith, Fort Smith, AR (US); James Smith, Sr., Fairburn, GA (US); Charleston Dakota Smith, Fort Smith, AR (US)

( * ) Notice: Subject to any disclaimer, the term of this patent is extended or adjusted under 35 U.S.C. 154(b) by 934 days.

(21) Appl. No.: 13/474,093

(22) Filed: May 17, 2012

(65) Prior Publication Data

US 2013/0305446 A1 Nov. 21, 2013

(51) Int. Cl.
*A61G 9/00* (2006.01)
*A61G 7/00* (2006.01)

(52) U.S. Cl.
CPC ..... *A61G 7/0005* (2013.01)

(58) Field of Classification Search
CPC ..... A61G 9/003
USPC ..... 4/451
See application file for complete search history.

(56) References Cited

U.S. PATENT DOCUMENTS

| | | | | | |
|---|---|---|---|---|---|
| 3,475,767 | A * | 11/1969 | Friesen et al. | 4/452 |
| 4,882,794 | A * | 11/1989 | Stewart, III | 4/451 |
| 5,991,923 | A * | 11/1999 | Maria | 2/83 |
| 6,070,277 | A * | 6/2000 | Thomas | 4/484 |
| 6,216,271 | B1 * | 4/2001 | Chen | 2/69 |
| 2002/0004949 | A1 * | 1/2002 | Spitzer | 4/451 |
| 2004/0216220 | A1 * | 11/2004 | Ernest et al. | 4/144.1 |
| 2010/0306913 | A1 * | 12/2010 | Zazzara et al. | 4/451 |
| 2011/0231981 | A1 * | 9/2011 | Appel et al. | 2/114 |

* cited by examiner

*Primary Examiner* — Huyen Le

(57) ABSTRACT

These new inventions aim to solve problems that are related to healthcare concerns. Each invention is designed to scope the needs of patients whether they are at home, in a nursing home, or a hospital facility. These products are designed to be hassle-free when removing them on and off the patient. Both of them will provide privacy, safety, and dignity allowing the patients to be respected. The privacy jacket is a two component garment with a medium top pocket on the left side. It also has an opening at the arm and neck with three snaps down the right side. The privacy jacket shields the body and provide warmth while the patient is using it, and it has a secret pocket inside the back panel. The pocket holds the collapsible disposable bucket. The disposable bucket is comprised of a soft, molded texture, with padded sections that absorbs both feces and urine. It has flexible elastic wings that expand into a bucket to fit underneath the shower chair. These devices will help improve the way patients receive healthcare.

13 Claims, 2 Drawing Sheets

DISPOSABLE SHOWER BUCKET AND THE PRIVACY JACKET

CROSS REFERENCE TO RELATED APPLICATIONS

Figures 1, 2, 3, 4, 5, 6:
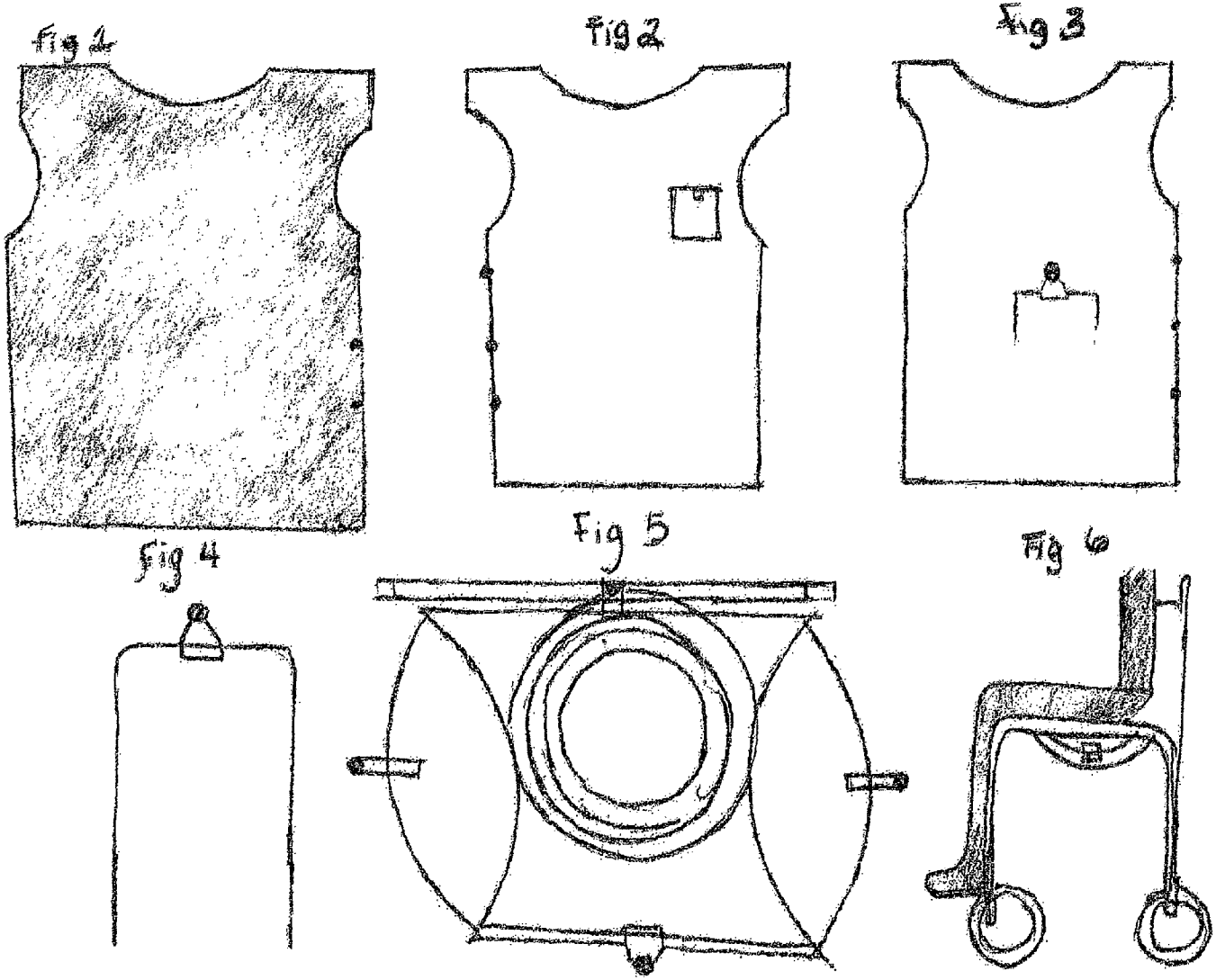
Figure 7:
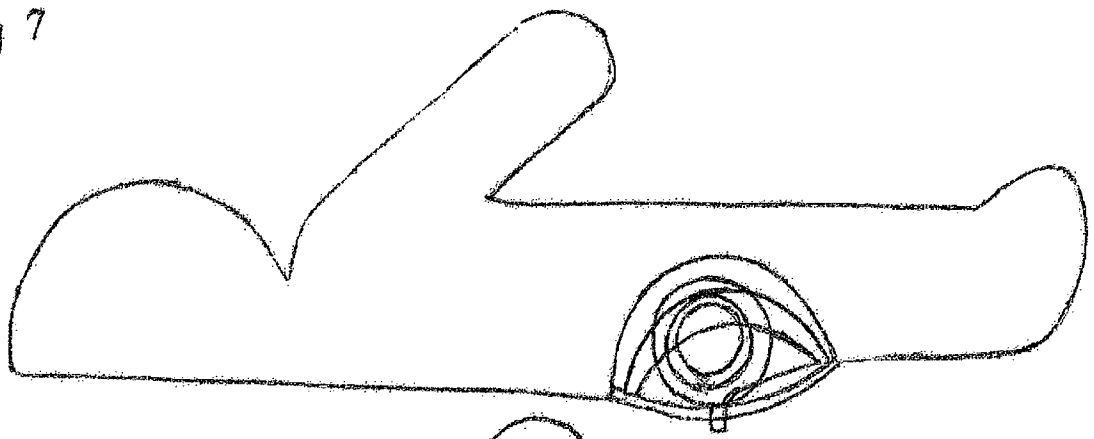
Figure 8:
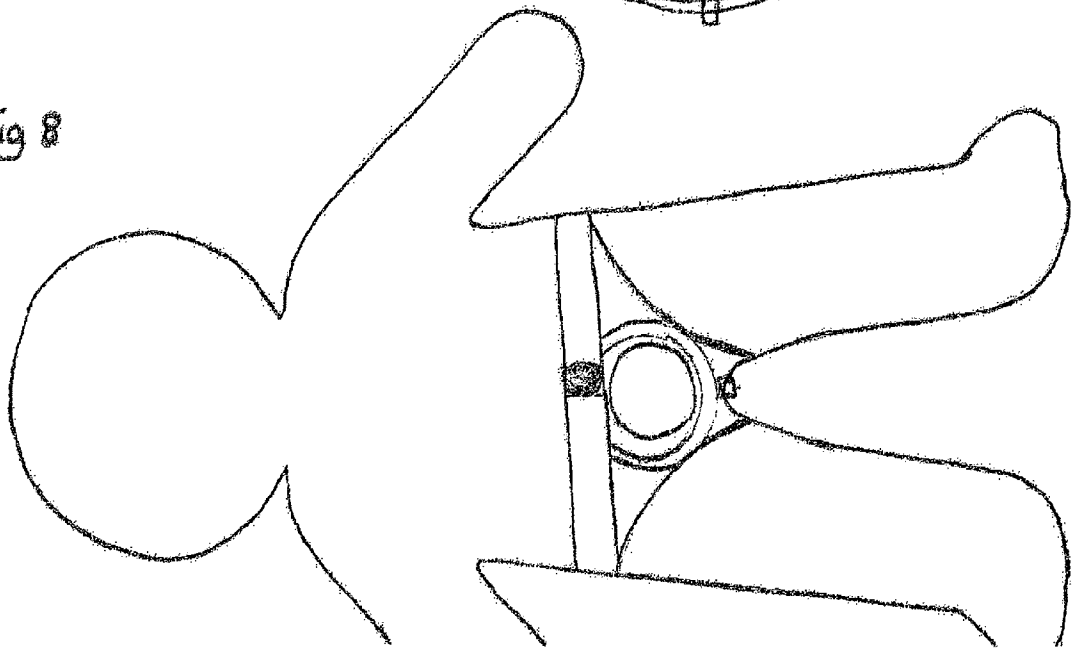

I claimed priority of the provisional application 61/518,981 filed on May 16, 2011, the provisional application 61/518,982 filed on May 16, 2011, and the provisional application 61/518,983 fled on May 11, 2016.
Appl No. 61/518,981 and 61/518,982 File Date: May 16, 2011 Current U.S. Current International.
Class: "Not Applicable"
Field of Search. Ser. Nos. 07/759,917, 06/342,285, 08/236,461, 08/492,172, 09/872,337, 08/280,597, U.S. Pat. Nos. 7,810,172, 4,975,984, 4,474,500, 4,547,907, 4,370,757, 6,484,321, 6,134,715, 5,946,722, 5,444,872, Ser. No. 07/366,649, U.S. Pat. Nos. 5,361,414, 5,575,006, 6,012,168, 4,964,173, 6,237,153, 6,499,143, 7,181,773, 7,865,973, 8,069,497.

INCORPORATION-BY-REFERENCE OF MATERIAL

References Cited

| U.S. Patent Documents | | | |
|---|---|---|---|
| 5,193,232 | 07/759/917 | March 1993 | Flood, et al |
| 4,368,548 | 06/342,285 | January 1983 | Glass |
| 5,375,270 | 08/236,461 | December 1994 | Demers, Jr., et al |
| 5,608,925 | 08/492,172 | March 1997 | Porter |
| 6,789,277 | 09/872,337 | September 2004 | Spitzer |
| 5,455,972 | 08/280,597 | October 1995 | Williams |
| 7,810,172 | 11/432,257 | October 2010 | Williams |
| 4,975,984 | 07/379,174 | December 1990 | Sting |
| 4,474,500 | 06/863/435 | July 1988 | Brucato, et al |
| 4,547,907 | 06/477,351 | October 1985 | Netsky |
| 4,370,757 | 06/359,946 | February 1983 | Richmond |
| 6,484,321 | 09/848/938 | November 2002 | Shamam |
| 6,134,715 | 09/507,911 | October 2000 | McLennan |
| 5,946,722 | 08/864,468 | September 1999 | Trautmann |
| 5,444,872 | Johnson | July 1994 | Johnson |
| 5,361,414 | 08/128,093 | November 1994 | Smith |
| 5,575,006 | 08/349/748 | November 1996 | Wolfe |
| 6,012,168 | 09/188/429 | January 2000 | Hutton, et al |
| 6,237,153 | 09/451/039 | May 2001 | Bowens |
| 6,499,143 | 09/829/663 | December 2002 | Garza |
| 7,181,773 | 11/193/190 | February 2007 | Piraka |
| 7,865,973 | 12/286/851 | January 2011 | Gibson |
| 8,069,497 | 12/319,258 | December 2011 | Sheward et al |

BACKGROUND OF THE INVENTION

I claimed priority of the provisional application 61/518,981 filed on May 16, 2011, and the provisional application 61/518,982 filed. On May 16, 2011. These present inventions relate to a disposable shower bucket and a privacy jacket to be used during the activities of daily living for patients in any healthcare facility. They are a new innovation for healthcare. The disposable shower bucket will bring healthcare from a problem to a solution aimed improving patient care. It is significant in meeting the patient's need; it can be utilized for a patient's rehabilitation and recovery needs, and is designed to be connected to the Privacy Jacket (U.S. Pat No. 61/518,982), while transporting a patient to and from the shower. This will ensures the personnel caring the patient to a more hassle and stress free experience.

The disposable shower bucket is also great for a patient who previously had a surgery, or amputation. Since these patients are unable to complete certain activities of daily living such as turning over, the disposable shower bucket gives the patient more support to complete basic anatomical movements. The disposable shower bucket is comprised of a soft, flexible bucket with a round texture. The inner layer is built to house all the patient's feces and urine in two layers. One layer controls all urine, where the urine is absorbed in a padded sector. All feces will be absorbed with layered padding, which can be doubled to apply and cushioning. When the inner padding becomes soiled with the patient's urine and feces can be easily removed, and replaced back with another new padding. This easy exchange provides a sense of ease and comfort to the patient. It does not take away from the special care that the healthcare worker must provide to the patient, but it does assist by making the job easier for healthcare worker to perform their duties efficiently. If the patient is feeling uncomfortable with the extra cushion, then it can be removed to fit the patient's desire for comfort. The disposable shower bucket can easily be removed without removing the entire bucket, which emphasizes the ease and accessibility that the disposable shower bucket provides both the patient and the patient care staff.

After years of patient care experience, the use of bedpans in patient care facilities have made healthcare workers jobs a lot harder. Most patients after surgery have a hard time using the bedpan and constantly complain about the irritability that the bedpan gives their skin. Some of the patients in healthcare facilities are fragile, underweight, bedridden, have decubitus ulcers, or a combination of the above and other conditions that require them use the bedpan. Some may also complain about the pain of the bedpan underneath them, and limited movements they are able to perform. The current bedpans on the market today are not only stressful and a hassle for the patients, but also to the healthcare workers that care for them. The current bedpans do not allow the workers to successfully clean the patient properly and respectively at the same time. Since the bedpan makes it more difficult to clean the patient, the healthcare worker must spend longer times cleaning. There are combinations of scenarios the worker may experience like: spillage while trying to get the bedpan from underneath the patient, the risk of sanitation, cross-contamination, or the risk of exposure resulting in loss of dignity for the patient. The disposable shower bucket will allow the workers to clean the patient properly and carefully without it being time consuming or a hassle. It provides ease of cleanliness by allowing the healthcare worker to change out the pads to maintain dryness and cleanliness based on the patient's needs, and it provides a since of dignity and comfort for the patient.

The present invention relates to a garment that can be used in any healthcare facility. It is very comfortable and unique. The privacy jacket is designed for total body coverage. The shoulders are round and smooth; the neckline has a wide opening which is great for a patient who may have a crate. The privacy jacket consists of a medium pocket with a small opening through the pocket that is great for oxygen tubes. It has medium-sized pockets on both sides to of the jacket. It flows down the torso, slightly passed the knees to ensure the privacy of the patient. The privacy jacket slides on comfortably and has three snaps closures on the right side. The privacy jacket contains an upside down pocket with a small center snap, located on the back inner panel of the garment that attaches to the disposable bucket. This back

SUMMARY OF THE INVENTION

These inventions operates effectively when used property putting patients risk-free of accidents. These products are much needed to improve the healthcare industry. The privacy jacket covers the patient, allowing the patient to feel respected and the disposable bucket will provide cleanliness while the patient is in bed or during transport, which gives the patient dignity. These inventions are miraculous in their own ways of providing healthcare, because they transform a patient's humanity. Since bedding sheets (often used in healthcare facilities) can cause accidents with its tugging around the wheel of the shower chair, the privacy jacket will fit securely and comfortably, and allow for ease of movement around the wheels. Other hospital gowns are thin and does not provide full closer for a patient. The privacy jacket will allow the patient to enjoy their hospital stay in comfort, and while providing a fast and safe way of using the bathroom, with its surprising disposable bucket, hidden inside the back panel.

When the patient is using the bedpan, healthcare aids have a difficult time cleaning them. They experience spillage and the patient's feces and urine are left on their bottoms, hit the floor, or create a mess when trying to clean as they remove the bedpan. When personnel use the disposable bucket, health care personnel will never have to worry about being contaminated with either urine or feces. Healthcare personnel will only have to remove one padding layer at a time, making it easier to clean the patient from front to back as recommend. Overall, these products work well together, saving time and money. They are hassle-free, and provides ease to the job for healthcare personnel.

BRIEF DESCRIPTION OF THE INVENTION

The invention will more fully be understood and apparent in the following detailed descriptions and illustrations in the accompanying drawings of the Privacy Jacket and the Disposable Bucket.

FIG. 1—(the privacy jacket) a full view of the back side of the privacy jacket. It has three medium snaps down the right side.

FIG. 2—(the privacy jacket) has one pocket on the left upper side, and three medium snaps down the right side.

The privacy jacket is a garment that holds a protective hidden pocket inside the back panel. The back panel has a snap attached to it as shown in FIG. (3), which supports the hidden pocket.

FIG. (4)—the pocket has a snap and is designed upside down, and attaches to FIG. (3). The pocket releases the disposable bucket.

FIG. (5)—The disposable bucket is collapsible, with a thin elastic circular band. It's made of a soft molded material. It has a wide elastic belt with two snap attachments on each side which stretches around the waist. It has three round flat molded circular layers inside which holds three pads in place. The pads are replaceable. It has two elastic wings on each side with snaps. The wings folds backwards and closes with its snaps.

FIG. (6)—The bucket easily fits though the back of the shower chair. When the wings are unsnapped it will expand to a disposable bucket. Then the elastic band stretches around the bottom opening of the shower chair. Its soft, molded material supports the weight of any waste, and the weight of the waste pushes down on the disposable bucket.

FIGS. (7) and (8) When a patient is lying in the bed using the disposable bucket the wings are folded backwards, which fits the patient like a diaper. The three collapsible layers allow more ease of care for healthcare workers. Once the first layer is utilized by the patient, the second and third layers are there to catch any further bodily waste.

DETAILED DESCRIPTION OF THE INVENTION

The disposable shower bucket is presented as a new innovation for healthcare. It is designed to replace the use of all bedpans currently being used in the healthcare facilities. It is designed to provide more cleanliness and comfort to patients who use bedpans to assist with their activities of daily living. The disposable bucket is made of a flexible, soft, and molded material designed to catch all the feces and urine exposed of by the body. Currently patients have to use very hard pans that catch and mix all the feces and urine, however, this is difficult to get under and out from under the patient. The disposable bucket is designed to catch the urine at one level (bottom), and the feces at another level (top) using disposable padding. The padding can be adjusted based on the patient's needs. This will keep the patients clean and dry during the day and night. Healthcare workers will experience such ease with cleaning and comforting patients. Most patients are bedridden, have pressure sores, decubitus ulcers, and are very fragile and underweight. Having to put the current large pans under these particular patients can hurt them and make them sore. It also limits their ability to turn and rotate in the bed. Since the disposable shower bucket is disposable, healthcare workers do not have to try to clean these buckets. They can simply change the padding according to the patient's needs or dispose of the bucket and get a new one.

The shower disposable shower bucket is made to be attached onto the inside of the Privacy Jacket, but can also be worn alone. This makes it easier for patients to use any garment when they need to be transported to different locations. The privacy jacket has a small pocket on the front right side panel of the garment that can hold medical devices or patient items. The upside down pocket on the inside panel of the back of the garment allows the disposable bucket to be hidden and easily released when needed. It has a snap closure to hold the bucket in place. The snap closures along the right side of garment allows ease to put on, easy access to the patient, and provides security. The privacy jacket provides comfort, a sense of dignity and pride to the patient when they are be cared for, and transported. With the disposable bucket the patients are able to feel clean and comfortable and not risk being exposed all at the same time.

The invention claimed is:

1. A privacy jacket in combination with a disposable bucket is a new improved hospital gown that provides an alternative for the use of bedpans by a patient in a health care environment, the privacy jacket comprising a front panel, a back panel, a neck opening formed at top edges of the panels, arm openings formed at left and right edges of the panels, and fasteners provided from the top edges of the panels to the right edges of the panels to connect the panels together to form the gown, wherein the back panel has a pocket holding the disposable bucket in place, the bucket comprises of adjustable elastic openings with two elastic wigs on the left and right sides of the panels and a belt closure.

2. The privacy jacket according to claim 1, wherein the front and back panels comprise a cloth material.

3. The privacy jacket according to claim 1, wherein the front panel has a pocket located on the right side.

4. The privacy jacket according to claim 1 further has at least three fasteners attached to the panels.

5. The privacy jacket according to claim 1 comprises a length that remains below a patient's knee when worn in a sitting position.

6. The privacy jacket according to claim 1, wherein the fasteners are snaps.

7. The privacy jacket according to claim 1, wherein the back panel has fasteners adapted for attacking a disposable bucket.

8. The privacy jacket according to claim 1, wherein is comprised of a round, soft, and collapsible material.

9. The privacy jacket according to claim 1 further the disposable bucket has at least four fasteners attaching to the panels.

10. The privacy jacket according to claim 1, wherein the fasteners are snaps.

11. The privacy jacket according to claim 1, the disposable bucket has one snap that attaches to the panels of the Privacy Jacket.

12. The privacy jacket according to claim 1, the disposable bucket has two snaps that attach from left and right sides to the belt closure.

13. The privacy jacket according to claim 1, the disposable bucket has one snap that attach from the back panel to the front panel to the belt closure.

* * * * *